United States Patent [19]

Sekiguchi

[11] 4,074,400

[45] Feb. 21, 1978

[54] FASTENINGS SUITABLE FOR PERSONAL ORNAMENTS

[75] Inventor: Nisuke Sekiguchi, Tokyo, Japan

[73] Assignee: Sekiguchi Seisakusho Co., Ltd., Tokyo, Japan

[21] Appl. No.: 775,426

[22] Filed: Mar. 8, 1977

[51] Int. Cl.[2] ..... A44G 17/00

[52] U.S. Cl. ..... 24/218

[58] Field of Search ..... 24/218, 217 W

[56] References Cited

U.S. PATENT DOCUMENTS

| | | | |
|---|---|---|---|
| 1,458,559 | 6/1923 | Sweet | 24/218 |
| 1,574,961 | 3/1926 | Fischer | 24/218 |

*Primary Examiner*—Bernard A. Gelak

*Attorney, Agent, or Firm*—Armstrong, Nikaido & Marmelstein

[57] ABSTRACT

The invention disclosed relates to a fastening suitable for a personal ornament, which comprises a male member (A) and a female member (B); the male member (A) including a base plate 21 on which a projecting portion 22 is provided; the female member (B) including a casing 23 which has a base plate 25 and an upstanding edge 26 formed by bending a marginal portion of the base plate 25. The base plate 25 has an opening 24 which can receive the projecting portion 22, and the upstanding edge 26 has an opening 27 through which an ornament-fitting portion 30 of a ring plate 28 may be projected outwards. The ring plate 28 has an opening 29 whose diameter is larger than that of the opening 24 of the base plate 25. The ring plate 28 has the ornament-fitting portion 30 in the form of a projection. The ring plate 28 is placed in the casing 23 in such a manner that the ornament-fitting portion 30 projects through the opening 27. A ring-like cover plate 31 is placed on the upper surface of the ring plate 28. The cover plate 31 has an opening 32 whose diameter is virtually the same as that of the opening 24 of the base plate 25. A partially opened annular spring 34 is placed on a recess channel which is defined by the upper surface of the base plate 25 of the casing 23, by the internal wall of the ring plate 28, which wall surrounds the opening 29, and by the lower surface of the ring-like cover plate 31, whereby the spring 34 is disposed on the recess channel in such a position that an internal portion of the spring 34 is present in an internal area of the openings 24 and 32. The upstanding edge 26 of the casing 23 is bent inwards to fix the ring-like cover plate 31.

1 Claim, 13 Drawing Figures

FASTENINGS SUITABLE FOR PERSONAL ORNAMENTS

BACKGROUND OF THE INVENTION

The present invention relates to improved fastenings suitable for personal ornaments such as necklaces, bracelets, belts and the like.

A fastening, which is to be used for linking one end portion to the other end portion of a necklace or bracelet to hold it in the form of an endless belt, should have a relatively small size in consideration of the appearance of the necklace or the bracelet. Usually, use is made of a small fastening having a length of about 6–8 mm and a width of about 3–5 mm.

A hook and eye type fastening is known. Also, a fastening, which has a male screw member and a female screw member, is known. However, the linking operation of such a small fastening behind a neck with the aid of fingers is sometimes troublesome, and required much time.

Furthermore, a modern fastening is also known, which comprises (a) a male member having a projecting portion a (b) a ring-like female member having a relatively large thickness and an opening sufficient to receive the above projecting portion. The internal wall of the ring-like female member is provided with a recess, onto which is partially opened annular spring is placed. When the projecting portion of the male member is forcibly inserted into the opening of the female member, the spring will resiliently engages with the a neck part of the projecting portion of the male member, so that the male member can be adequately engaged with the female member. From the above, it will be seen that the locking and unlocking operations in the modern fastening can be carried out rapidly without any difficulty. However, this fastening has such a drawback that it is difficult to provide the recess by shaving the internal wall of the ring-like female member. Furthermore, it is also difficult to place the partially opened annular spring onto the recess. So, it is unavoidable that the cost for making the modern fastening is considerably high.

It is an object of the invention to provide improved fastenings of the above-mentioned type, which are suitable for personal ornaments. The present fastenings can be manufactured easily and cheaply with high efficiency even on a large commercial scale.

These and other objects, features and advantages of the invention will become apparent from consideration of the following descriptions and the accompanying drawings which are illustrative of a preferred embodiment of the invention.

SUMMARY OF THE INVENTION

The present invention relates to a fastening suitable for a personal ornament, which comprises a male member (A) and a female member (B); the male member (A) including a base plate 21 on which a projecting portion 22 is provided; the female member (B) including a casing 23 which has a base plate 25 and an upstanding edge 26 formed by bending a marginal portion of the base plate 25; the base plate 25 having an opening 24 which can receive the projecting portion 22; the upstanding edge 26 having an opening 27 through which an ornament-fitting portion 30 of a ring plate 28 may be projected outwards; the ring plate 28 having an opening 29 where whose diameter is larger than that of the opening 24 of the base plate 25; the ring plate 28 having the ornament-fitting portion 30 in the form of a projection; the ring plate 28 being placed in the casing 23 in such a manner that the ornament-fitting portion 30 projects through the opening 27; a ring-like cover plate 31 being placed on an upper surface of the ring plate 28; the cover plate 31 having an opening 32 whose diameter is virtually the same as that of the opening 24 of the base plate 25; a partially opened annular spring 34 being placed on a recess channel which is defined by the upper surface of the base plate 25 of the casing 23, by the internal wall of the ring plate 28, which wall surrounds the opening 29, and by the lower surface of the ring-like cover plate 31, whereby the spring 34 is disposed on the recess channel in such a position that an internal portion of the spring 34 is present in an inner area of the openings 24 and 32; the upstanding edge 26 of the casing 23 being bent inwards to fix the ring-like cover plate 31.

DETAILED DESCRIPTION OF THE PREFERRED EMBODIMENTS

Figure 1:
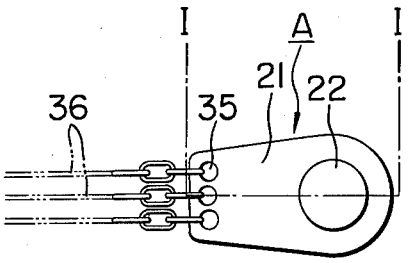
FIG. 1 shows a plan view of a male member of a fastening which has been manufactured according to an embodiment of the invention.
Figure 2:
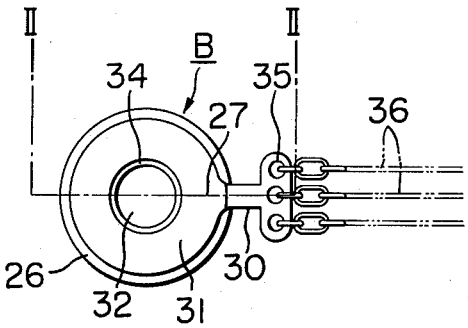
FIG. 2 shows a plan view of a female member of the fastening.
Figure 3:
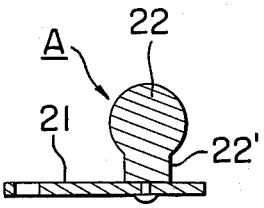
FIG. 3 shows a longitudinal cross-sectional view taken along the line I—I in FIG. 1.
Figure 4:
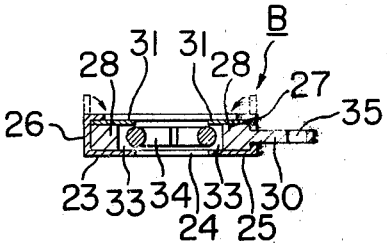
FIG. 4 shows a longitudinal cross-sectional view taken along the line II—II in FIG. 2.
Figure 5:
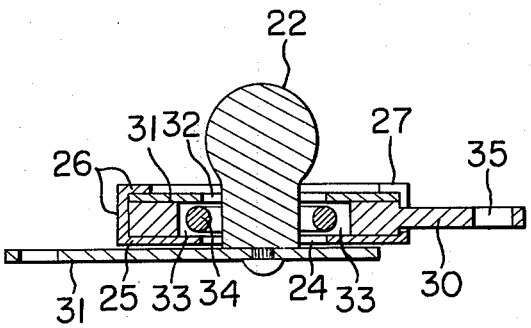
FIG. 5 shows an enlarged longitudinal cross-sectional view of the male member which has been linked to the female member.
Figure 6:
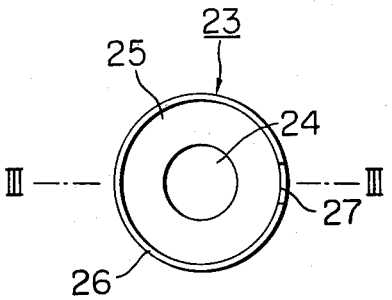
FIG. 6 shows a plan view of the casing of the female member.
Figure 8:
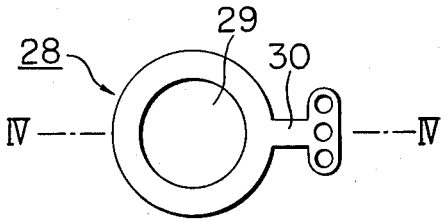
FIG. 8 shows a plan view of the ring plate.
Figure 7:
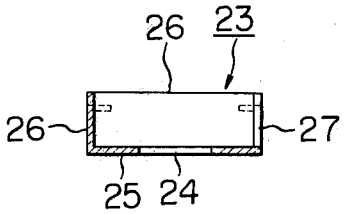
FIG. 7 shows a cross-sectional view taken along the line III—III in FIG. 6.
Figure 9:
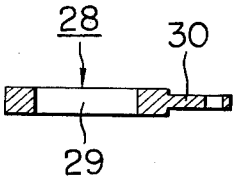
FIG. 9 shows a longitudinal cross-sectional view taken along the line IV—IV in FIG. 8.
Figure 10:
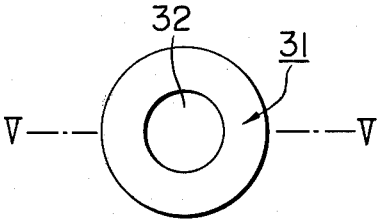
FIG. 10 shows a plan view of a cover plate.
Figure 12:
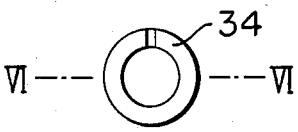
FIG. 12 shows a plan view of a partially opened annular spring.
Figure 11:
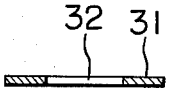
FIG. 11 shows a longitudinal cross-sectional view taken along the line V—V in FIG. 10.
Figure 13:
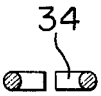
FIG. 13 shows a longitudinal cross-sectional view taken along the line VI—VI in FIG. 12.

The fastening, which is illustrated in the drawings, is an example of the present fastenings, and has a female member (B) in the form of a disc-like plate.

This fastening has a male member (A) which comprises a long and narrow base plate 21 provided with a projecting portion 22. The female member (B) comprises an annular base plate 25 having a circular opening 24 at the center of the plate 25. A marginal portion of the base plate 25 is bent upwards to form an upstanding edge 26, so that a casing 23 is formed.

The upstanding edge 26 has an opening 27 through which an ornament-fitting portion 30 of a ring plate 28 may be projected outwards. The ring plate 28 is relatively thick and has an opening 29 at its center; the diameter of the opening 29 is larger than that of the opening 24 of the base plate 25. As shown above, the ring plate 28 has the ornament-fitting portion 30 projected therefrom. The ring plate 28 is placed on the base plate 25 of the casing 23 in such a manner that the ornament-fitting portion 30 projects out the opening 27. On the ring plate 28, a ring-like cover plate 31 is placed. The cover plate 31 has an opening 32 at its center; the diameter of the opening 32 is virtually the same as that of the opening 24 in the base plate 25 of the casing 23.

In case of this female portion (B), there is a recess channel 33, which is defined by the upper surface of the base plate 25 of the casing 23, by the internal wall surrounding of the opening 29 of the ring plate 28, and by the lower surface of the ring-like cover plate 31. Thus, the recess channel 33 is present on the internal wall which surrounds the opening of the female portion (B). A partially opened annular ring-like spring 34 is put on the recess channel 33. Thereafter, the upstanding edge 26 is bent inwards to fix the ring-like cover plate 31. Openings 35 are employed to attach the fastening to chain or string members of a bracelet or necklace.

When the projecting portion 22 of the male member (A) is inserted into the opening of the female member (B), the neck part 22' of the projecting portion 22 will be surrounded and resiliently engaged with the partially opened annular ring-like spring 34, whereby male portion (A) will be adequately linked to the female portion (B).

When it is desired to unfasten the male portion-female portion linkage, the top of the projecting portion 22 of the male portion (A) may be pushed so as to disengage the projecting portion 22 from the partially opened annular spring 34, so that the male portion (A) will be unlocked from the female member (B).

The female member (B), which has the structure mentioned above, may be manufactured in the following manner. The ring plate 28 is placed in the casing 23. The partially opened annular spring 34 is placed on the L-shaped recess, which is defined by the base plate 25 of the casing 23 and by the internal wall which surrounds the opening 29 of the ring plate 28. The ring-like cover plate 31 is then placed on the spring 34, and the upstanding edge 26 of the casing 23 is bent inwards so as to fix the cover plate 31, whereby the partially opened annular ring-like spring 34 can be held at a desired position without any risk of jumping out of the spring.

As shown above, the female member (B) can be produced more easily as compared with a known female member which is produced by a process, wherein an opening is made in a thick plate, and a recess channel is formed by shaving off the wall which surrounds the periphery of the opening. Thus, it is a remarkable advantage of the invention that a fastening suitable for a personal ornament can be rapidly and cheaply produced in a simple manner.

I Claim:

1. A fastening suitable for a personal ornament, which comprises a male member (A) and a female member (B); the male member (A) including a base plate 21 on which a projecting portion 22 is provided; the female member (B) including a casing 23 which has a base plate 25 and an upstanding edge 26 formed by bending a marginal portion of the base plate 25; the base plate 25 having an opening 24 which can receive the projecting portion 22; the upstanding edge 26 having an opening 27 through which an ornament-fitting portion 30 of a ring plate 28 may be projected outwards; the ring plate 28 having an opening 29 whose diameter is larger than that of the opening 24 of the base plate 25; the ring plate 28 having the ornament-fitting portion 30 in the form of an projection; the ring plate 28 being placed in the casing 23 in such a manner that the ornament-fitting portion 30 projects through the opening 27; a ring-like cover plate 31 being placed on the upper surface of the ring plate 28; the cover plate 31 having an opening 32 whose diameter is virtually the same as that of the opening 24 of the base plate 25; a partially opened annular spring 34 being placed on a recess channel which is defined by the upper surface of the base plate 25 of the casing 23, by the internal wall of the ring plate 28, which wall surrounds the opening 29, and by the lower surface of the ring-like cover plate 31, whereby the spring 34 is disposed on the recess channel in such a position that an internal portion of the spring 34 is present in an inner area of the openings 24 and 32; the upstanding edge 26 of the casing 23 being bent inwards to fix the ring-like cover plate 31.

* * * * *